United States Patent [19]

Nagai et al.

[11] 4,129,524

[45] Dec. 12, 1978

[54] RADIATION SHIELDING MATERIAL AND A PROCESS FOR PRODUCING THE SAME

[75] Inventors: Haruo Nagai; Hiroshi Uehara, both of Nakajo; Kunikazu Nunokawa, Kurokawa, all of Japan

[73] Assignee: Kyowa Gas Chemical Industry Co., Ltd., Tokyo, Japan

[21] Appl. No.: 815,175

[22] Filed: Jul. 13, 1977

[30] Foreign Application Priority Data

Jul. 16, 1976 [JP] Japan ..... 51-84617
Jun. 6, 1977 [JP] Japan ..... 52-65728

[51] Int. Cl.[2] ..... G21F 1/10
[52] U.S. Cl. ..... 252/478; 252/300; 526/192
[58] Field of Search ..... 252/478, 300; 250/517, 250/520; 526/240, 192

[56] References Cited

U.S. PATENT DOCUMENTS

| | | | |
|---|---|---|---|
| 2,403,794 | 7/1976 | Goldrick et al. | 252/478 |
| 3,148,160 | 9/1964 | Malm et al. | 252/478 |
| 3,608,555 | 9/1971 | Greyson | 252/478 |
| 3,715,331 | 2/1973 | Molnar | 252/478 |
| 3,974,104 | 8/1976 | Foster et al. | 526/240 |
| 4,022,960 | 5/1977 | Mima et al. | 526/240 |

FOREIGN PATENT DOCUMENTS

| | | | |
|---|---|---|---|
| 456596 | 5/1949 | Canada | 252/478 |

*Primary Examiner*—Benjamin R. Padgett
*Assistant Examiner*—Deborah L. Kyle
*Attorney, Agent, or Firm*—Gordon W. Hueschen

[57] ABSTRACT

A radiation shielding material of a composition containing a polymer comprising (A) at least one essential monomer selected from the group consisting of alkyl methacrylate having 1 - 4 carbon atoms in an alkyl group, hydroxyalkyl acrylate, hydroxyalkyl methacrylate and styrene and (B) lead acrylate or lead methacrylate, and a lead carboxylate represented by the general formula: $(RCOO)_aPb$, a being an integer equal to the valency of lead and R representing a saturated or unsaturated hydrocarbon residue having 5 - 20 carbon atoms, wherein the ratio x (% by weight) of the lead acrylate or lead methacrylate to the total constituent monomer in the polymer and the compounding ratio y (parts by weight) of the lead carboxylate to 100 parts by weight of said total monomer in said composition satisfy any one of the following three formulas I, II and III:

$$200 \geqq y \geqq 2, \text{ where } 9 \leqq x \leqq 30 \quad \text{(I)}$$

$$200 \geqq y \geqq 2/5(x - 30) + 2, \text{ where } 30 \leqq x \leqq 75 \quad \text{(II) and}$$

$$200 \geqq y \geqq -9/10(x - 75) + 20, \text{ where } 75 \leqq x \leqq 95 \quad \text{(III).}$$

34 Claims, No Drawings

RADIATION SHIELDING MATERIAL AND A PROCESS FOR PRODUCING THE SAME

The present invention relates to a radiation shielding material with an improved optical transparency and a mechanical strength, as well as to a process for producing the same.

It is known that a transparent radiation shielding material is obtainable from lead acrylate or lead methacrylate by polymerizing it at a temperature above the melting point thereof but the resulting material is very fragile and cannot be put to practical use in view of forming, fabrication and handling. While it is possible to improve the strength of such material by polymerizing lead acrylate or lead methacrylate in admixture with a copolymerizable monomer such as methyl methacrylate, the polymer thus prepared generally loses it transparency to exhibit an opaque or opaque white appearance in a composition comprising such a lead content as to satisfy to some extent both of the radiation shielding performance and mechanical strength. For instance, while lead methacrylate can be mixed at a temperature above its melting point with methyl methacrylate at any compounding ratio to form a uniform and transparent mixture, the ratio of lead methacrylate in the mixture capable of providing a transparent polymer upon polymerization lies less than about 6% by weight, where practical radiation shielding performance is not attained or more than about 95% by weight, where practical mechanical strength is lost.

It is, accordingly, an object of the present invention to provide a novel radiation shielding material and a process for producing the same.

Another object of the present invention is to provide a radiation shielding polymer material highly excellent both in the optical transparency and in the mechanical strength.

The foregoing objects can be attained by a radiation shielding material of a composition containing; a polymer comprising (A) at least one essential monomer selected from the group consisting of alkyl methacrylate having 1–4 carbon atoms in an alkyl group, hydroxyalkyl acrylate, hydroxyalkyl methacrylate and styrene and (B) lead acrylate or lead methacrylate, and a lead carboxylate represented by the general formula: $(RCOO)_aPb$, a being an integer equal to the valency of lead and R representing a saturated or unsaturated hydrocarbon residue non-substituted or substituted with a hydroxyl group and having 5–20 carbon atoms, wherein the ratio x (% by weight) of the lead acrylate or the lead methacrylate to the total constituent monomer in the polymer and the compounding ratio y (parts by weight) of the lead carboxylate to 100 parts by weight of said total monomer in said composition safisfy anyone of the following three formulas I, II and III:

$$200 \geqq y \geqq 2, \text{ where } 9 \leqq x \leqq 30 \quad \text{(I)},$$

$$200 \geqq y \geqq 2/5\,(x - 30) + 2, \text{ where } 30 \leqq x \leqq 75 \quad \text{(II) and}$$

$$200 \geqq y \geqq -(9/10)\,(x - 75) + 20, \text{ where } 75 \leqq x \leqq 95 \quad \text{(III)}.$$

The radiation shielding material according to the present invention can be obtained by polymerizing a monomer mixture comprising (A) at least one essential monomer selected from the group consisting of alkyl methacrylate, having 1–4 carbon atoms in an alkyl group, hydroxyalkyl acrylate, hydroxyalkyl methacrylate and styrene and (B) lead acrylate or lead methacrylate in the presence of the above lead carboxylate represented by the general formula: $(RCOO)_aPb$, a and R representing the same contents as above, wherein the ratio x (% by weight) of the lead acrylate or the lead methacrylate to the above monomer mixture and the ratio y (parts by weight) of the above lead carboxylate to 100 parts by weight of the above monomer mixture satisfy anyone of the above formulas I, II and III.

It has been anticipated so far that the inclusion of the above lead carboxylate in a specified amount of range to the above material can maintain a high transparency thereof as in the present invention. Although the above mechanism cannot wholly been explained theoretically at present, this is very important in industrial and medical points of view in that it provides a material of a practical radiation shielding performance excellent both in the mechanical strength and in the optical transparency.

Alkyl methacrylate used herein includes those having 1–4 carbon atoms in an alkyl group such as methyl methacrylate, ethyl methacrylate, n-propyl methacrylate, isopropyl methacrylate, n-butyl methacrylate, sec-butyl methacrylate, tert-butyl methacrylate and the like and methyl methacrylate is preferred among all.

Hydroxyalkyl acrylate and hydroxyalkyl methacrylate used herein may be substituted or non-substituted ones and preferably include, for example, 2-hydroxyethyl acrylate, 2-hydroxyethyl methacrylate, 2-hydroxypropyl acrylate, 2-hydroxypropyl methacrylate, 3-hydroxypropyl acrylate, 3-hydroxypropyl methacrylate, 4-hydroxybutyl methacrylate, 2-hydroxy-3-chloropropyl acrylate, 2-hydroxy-3-chloropropyl methacrylate and the like.

Partial substitution of the above essential monomer with other copolymerizable monomer in such an extent as giving no adverse affections to the effect of the present invention is also encompassed within the scope of the present invention. Such copolymerizable comonomer includes, for example, methyl acrylate, ethyl acrylate, isopropyl acrylate, n-butyl acrylate, vinyl acetate, vinyl chloride, acrylonitrile, methacrylonitrile and the like.

In the general formula: $(RCOO)_aPb$ for representing the lead carboxylate, a is an integer equal to the valency of lead being, usually, between 2–4 and, preferably, 2. R is a saturated or unsaturated hydrocarbon residue non-substituted or substituted with a hydroxy group and having 5–20 carbon atoms and, preferably, an aliphatic hydrocarbon group having 5–18 carbon atoms. As the carbon number decreases to 4 or below or increases to 21 or above, the transparency and/or mechanical strength of the resulting composition are unsatisfactory to hinder the complete attainment of the objects of the present invention. Typical examples of the lead carboxylate include lead hexanoate, lead heptanoate, lead octanoate, lead nonanoate, lead decanoate, lead laurate, lead myristate, lead palmitate, lead stearate, lead arachidate, lead 2-hexenoate, lead 9-decenoate, lead linderate, lead lauroleate, lead myristoleate, lead palmitoleate, lead petroselinate, lead oleate, lead elaidate, lead linoleate, lead linolenate, lead sorbate, lead geranate, lead ricinoleate, lead ricinelaidate, lead naphthenate, lead octylbenzoate and the like.

In the above polymer consisting of the above essential monomer (including also the above substituent monomer) and lead acrylate or lead methacrylate, with the lead acrylate or methacrylate content less than 9% by weight, practical radiation shielding effect cannot be obtained and, on the other hand, with the above content more than 95% by weight, the practical mechanical strength is not enough while the shielding effect is satisfactory.

According to the present invention, a transparent and tough radiation shielding material composed of the above polymer containing 9–95% by weight of lead acrylate or lead methacrylate, impossible to produce so far, can be prepared from the monomer comprising the foregoing essential monomer (including also the above substituted monomer) and lead acrylate or lead methacrylate while incorporating the lead carboxylate so that the ratio x (% by weight) of the lead acrylate or the lead methacrylate to the total monomer and the compounding ratio y (parts by weight) of the above lead carboxylate to 100 parts by weight of the total monomer can satisfy anyone of the above formulas I, II and III. If the lead acrylate or methacrylate content is relatively low in the material of the present invention, the lead content therein on the basis of the lead acrylate or lead methacrylate is reduced due to the coexistence of the above lead carboxylate, but the practical radiation shielding performance of the material is not lost since the total lead content is compensated by the lead content supplied from the lead carboxylate. Where the compounding amount of the above lead carboxylate is below the lower limit defined by the above formulas I, II or III, the resulting material is not generally transparent but shows an opaque to opaque white or ununiform appearance. While on the other hand, excessive use of the lead carboxylate above a certain limit can provide no further improvement in the transparency over a certain level but rather reduces the mechanical strength and causes bleeding to the material. The compounding ratio y, therefore, lies not more than 200 parts and, preferably, 100 parts by weight.

Further, according to the present invention, an optically transparent radiation shielding material with the remarkably increased mechanical strength can be provided by a composition containing a polymer comprising (A) a substrate monomer comprising (a) at least one essential monomer selected from the group consisting of alkyl methacrylate having 1–4 carbon atoms in an alkyl group, hydroxyalkyl acrylate, hydroxyalkyl methacrylate and styrene, and (b) a monomer contained in 8–75% by weight to the substrate monomer and represented by the general formula IV:

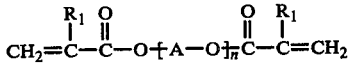

(IV).

wherein $R_1$ is H or $CH_3$, A is an alkylene group having 2–4 carbon atoms and n is an integer between 2 and 60 and/or the general formula V:

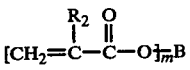

(V), where $R_2$ is H or $CH_3$, B is a saturated or unsaturated hydrocarbon residue having 4–24 carbon atoms and m is an integer between 2 and 4 and (B) lead acrylate or lead methacrylate, and a lead carboxylate represented by the general formula: $(RCOO)_aPb$, a being an integer equal to the valency of lead and R representing a saturated or unsaturated hydrocarbon residue nonsubstituted or substituted with a hydroxyl group and having 5–20 carbon atoms, wherein the ratio x (% by weight) of the lead acrylate or the lead methacrylate to the total constituent monomer in the polymer and the compounding ratio y (parts by weight) of the lead carboxylate to 100 parts by weight of said total monomer in said composition can satisfy either of the following formulas I or II:

$$200 \geqq y \geqq 2, \text{ where } 9 \leqq x \leqq 30 \qquad \text{I and}$$

$$200 \geqq y \geqq 2/5(x - 30) + 2, \text{ where } 30 \leqq x \leqq 75 \qquad \text{II.}$$

The above radiation shielding material is obtainable by polymerizing the monomer mixture of (A) a substrate monomer comprising (a) at least one essential monomer selected from the group consisting of alkyl methacrylate having 1–4 carbon atoms in an alkyl group, hydroxyalkyl acrylate, hydroxyalkyl methacrylate and styrene and (b) a monomer contained in 8–75% by weight to the substrate monomer and represented by the general formula IV and/or V and (B) lead acrylate or lead methacrylate in the presence of a lead carboxylate represented by the general formula: $(RCOO)_aPb$, a and R having the same meanings as above, wherein the ratio x (% by weight) of the lead acrylate or lead methacrylate to the monomer mixture and the ratio y (parts by weight) of the lead carboxylate to 100 parts by weight of the above monomer mixture can satisfy either of the foregoing formulas I or II.

A polyfunctional monomer represented by the general formula IV and/or V is contained in 8–75% and, preferably, 12–60% by weight to the total amount of the substrate monomer consisting of said polyfunctional monomer and the above essential monomer (including also the above substituent monomer). With said monomer content less than 8% by weight, no substantial effect is obtainable for the improvement in mechanical strength and, on the other hand, said monomer content in excess of 75% by weight no more has a strength improving effect in proportion to the increased content but may rather result in adverse effects on physical properties such as reduction in transparency, as well as reduction in machinability.

In the general formula IV for representing one of the above monomers, n is an integer between 2–60 and, preferably, 3–30. If n exceeds 60, the improving effect for the strength is entirely or substantially lost. The monomer represented by the above formula IV includes, for example, polyethyleneglycol diacrylate, polyethyleneglycol dimethacrylate, polypropyleneglycol diacrylate, polypropyleneglycol dimethacrylate and polybutyleneglycol dimethacrylate.

In the general formula V representing the other of the above monomers, B is a saturated or unsaturated hydrocarbon residue having 4–25 and, preferably, 4–15 carbon atoms and m is an integer between 2–4, and, preferably, 2. If the number of carbon atoms is less than 4, the effect for increasing the mechanical strength is poor and, on the other hand, the carbon atom number in excess of 25 provides a considerably low effect for increasing the mechanical strength relative to the increased number but rather results in adverse effects on the transparancy. Preferred examples of the monomer having the general formula V include: 1,6-hexanediol diacrylate, 1,6-hexanediol dimethacrylate, 1,3-butanediol diacrylate, 1,3-butanediol dimethacrylate, trimethylolpropane triacrylate, trimethylolpropane trimethacrylate, tetramethylolmethane tetraacrylate, tetramethylolmethane tetramethacrylate, 1,12-dodecanediol diacrylate, 1,12-dodecanediol dimethacrylate, neopentylglycol dimethacrylate and the like.

The radiation shielding material according to the present invention may be produced by any process providing that the above polymer composition containing a polymer comprising lead acrylate or lead methacrylate and the above essential monomer or the above substrate monomer, and the above lead carboxylate can be produced as the result and it is convenient to mix the monomer ingredients and the lead carboxylate in a specified ratio and, if required, heat the mixture to prepare a uniform liquid and effect polymerization in a mold or an extruder in the presence of an initiator for radical polymerization. The polymerization reaction is effected at a temperature usually between −10° C. and +150° C. and, preferably, 40° and 130° C. The initiator for radical polymerization is used, usually, in 0.001 to 5% and preferably, 0.02 to 1.0% by weight of the total monomer used. Typical examples of the initiator include lauroyl peroxide, tert-butyl peroxyisopropyl carbonate, benzoyl peroxide, dicumyl peroxide, tert-butyl-peroxyacetate, tert-butyl peroxybenzoate, di-tert-butyl peroxide, 2,2'-azobis-isobutyronitrile and the like.

This invention is to be described in details referring to the working examples and controls thereof.

EXAMPLES 1–15

The ingredients shown in Table 1 were mixed together and heated, to which lauroyl peroxide or tert-butyl peroxyisopropylcarbonate as an initiator for radical polymerization was added to dissolve in 0.1 parts by weight of the initiator to 100 parts by weight of the total mixture as shown in Table 1. The liquid thus prepared was cast into a cell assembled with two glass plates and a vinyl chloride resin gasket and then subjected to polymerization in a nitrogen atmosphere at 80° C. for 5 hours and then at 120° C. for 1 hour. After the completion of the polymerization, the cell was disassembled to take out a transparent sheet. The properties of the cast sheets thus obtained are shown in Table 2.

Controls 1–4

Sheets were prepared from the ingredients shown in Table 1 and in the same procedures as in Example 1. The properties of the cast sheets thus obtained are also shown in Table 2.

Table 1

| Ingredients | | | | | | | | | | |
|---|---|---|---|---|---|---|---|---|---|---|
| Ex. No. | Alkyl methacrylate (g) | | Styrene (g) | Hydroxyalkyl methacrylate (g) | | Lead acrylate or methacrylate (g) | Other monomer ingredient (g) | Lead carboxylate (g) | | Polymerization initiator |
| Ex. 1 | MMA | 17 | 16 | HEMA | 17 | Lead methacrylate /50 | — | Lead octanoate | 40 | L |
| " 2 | — | | 80 | — | | Lead methacrylate /15<br>Lead acrylate /10 | Methyl acrylate 5<br>Vinyl acetate 5 | Lead naphthenate | 20 | L |
| " 3 | tert-Butyl methacrylate | 5 | 30 | HCPMA | 65 | Lead methacrylate /65 | — | Lead octanoate | 60 | B |
| " 4 | MMA | 15 | 15 | HEMA<br>HPA | 10<br>10 | Lead methacrylate /50 | — | Lead linolenate | 12 | L |
| " 5 | MMA | 65 | — | HEA | 20 | Lead methacrylate /15 | — | Lead octanoate | 5 | L |
| " 6 | MMA | 5 | 5 | HEMA | 5 | Lead methacrylate /70<br>Lead acrylate /15 | — | Lead octanoate | 100 | B |
| " 7 | MMA | 75 | 5 | HEA | 10 | Lead methacrylate /15<br>Lead acrylate /10 | — | Lead linoleate | 20 | B |
| " 8 | MMA | 17 | 16 | HEMA | 17 | Lead methacrylate /50 | — | Lead oleate | 40 | B |
| " 9 | MMA | 76.5 | 9.5 | — | | Lead methacrylate 14 | — | Lead decanoate | 20 | B |
| " 10 | MMA | 15 | 15 | HPA | 20 | Lead methacrylate 50 | — | Lead myriatate | 20 | B |
| " 11 | MMA<br>Ethyl methacrylate | 45<br>20 | — | HEMA | 20 | Lead methacrylate 15 | — | Lead stearate | 5 | B |
| " 12 | MMA | 76.5 | 9.5 | — | | Lead methacrylate 14 | — | Lead myristoleate | 19 | B |
| " 13 | MMA | 15 | 15 | HEMA | 20 | Lead methacrylate 50 | — | Lead hexanoate | 20 | B |
| " 14 | MMA | 76.5 | 9.5 | — | | Lead methacrylate 14 | — | Lead ricinoleate | 19 | B |
| " 15 | MMA | 76.5 | 9.5 | — | | Lead methacrylate 14 | — | Lead octanoate decanoate | 19 | B |
| Control 1 | — | | — | — | | Lead methacrylate 100 | — | — | L | |
| " 2 | MMA | 30 | 30 | HEMA | 10 | Lead methacrylate 30 | — | — | B | |
| " 3 | MMA | 15 | 10 | HEMA | 15 | Lead methacrylate 60 | — | Lead octanoate | 10 | L |
| " 4 | — | | — | — | | Lead methacrylate 30 | Vinyl acetate /35<br>Acrylonitrile | Lead octanoate | 10 | B |

Table 1-continued

| Ex. No. | Alkyl methacrylate (g) | Styrene (g) | Hydroxyalkyl methacrylate (g) | Lead acrylate or methacrylate (g) | Other monomer ingredient (g) | Lead carboxylate (g) | Polymerization initiator |
|---|---|---|---|---|---|---|---|
| | | | | | /35 | | |

MMA = methyl methacrylate
HEMA = 2-hydroxyethyl methacrylate
HCPMA = 2-hydroxy-3-chloropropyl methacrylate
HPA = 2-hydroxypropyl acrylate
HEA = 2-hydroxyethyl acrylate
L = lauroyl peroxide (polymerization initiator)
B = tert-butyl peroxyisopropylcarbonate (polymerization initiator)
Lead octanoate decanoate in Example 15 was prepared as follows: a mixture of 1.1 mol of decanoic acid, 1.1 mol of octanoic acid and 1 mol of lead monoxide was heated at 60° C in toluene for 4 hours, and then toluene was removed under reduced pressure.

Table 2

| Example No. | | Thickness (mm) | Transparency | Total light transmittance(%) | Dynstat impact strength** (kg-cm/cm²) | Lead equivalent*** (mm Pb) |
|---|---|---|---|---|---|---|
| Example | 1 | 8 | O | 89 | 2.8 | 0.34 |
| " | 2 | 10 | O | 87 | 7.6 | 0.21 |
| " | 3 | 8 | O | 88 | 4.3 | 0.29 |
| " | 4 | 8 | O | 75 | 3.1 | 0.29 |
| " | 5 | 8 | O | 77 | 9.5 | 0.12 |
| " | 6 | 8 | O | 73 | 0.8 | 0.56 |
| " | 7 | 8 | O | 88 | 7.8 | 0.15 |
| " | 8 | 8 | O | 87 | 3.1 | 0.29 |
| " | 9 | 8 | O | 85 | 9.1 | 0.13 |
| " | 10 | 8 | O | 77 | 3.2 | 0.29 |
| " | 11 | 8 | O | 72 | 9.3 | 0.11 |
| " | 12 | 8 | O | 84 | 8.9 | 0.12 |
| " | 13 | 8 | O | 75 | 3.3 | 0.33 |
| " | 14 | 8 | O | 82 | 9.0 | 0.12 |
| " | 15 | 8 | O | 83 | 8.9 | 0.13 |
| Control | 1 | 8 | O | — | <0.1 | 0.79 |
| " | 2 | 8 | X | 5 | 8.3 | 0.21 |
| " | 3 | 8 | X | 3 | 3.8 | 0.36 |
| " | 4 | 8 | X | 2 | 7.9 | 0.24 |

*Total light transmittance was measured according to ASTM D 1003.
**Dynstat impact strength was measured according to DIN 53453 (without notch).
***Lead equivalent represents the value for X-ray at the energy of 68.8 keV.
O presence of transparency
X absence of transparency.

EXAMPLES 16–22

The ingredients shown in Table 3 were compounded together and heated, to which tert-butyl peroxyisopropylcarbonate as a radical polymerization initiator was added to dissolve in 0.1 parts by weight of the initiator to 100 parts by weight of the total mixture. The solution thus prepared was cast into a cell assembled with two glass plates and a vinyl chloride resin gasket and then subjected to polymerization in a nitrogen atmosphere at a temperature of 70° C. for 5 hours and then at 120° C. for 1 hour. After the completion of the polymerization, the cell was disassembled to take out a transparent sheet. The properties of the sheets thus obtained are shown in Table 4.

Controls 5–11

Sheets were prepared from the ingredients shown in Table 3 and in the same procedures as in Example 16. The properties of the cast sheets thus obtained are also shown in Table 4.

Table 3

| Example No. | | Substrate Monomer: Alkyl methacrylate (g) | | Styrene (g) | Hydroxyalkyl (meth(acrylate (g) | | Other substrate monomer ingredient (g) | | Lead acrylate or methacrylate (g) | Lead carboxylate (g) |
|---|---|---|---|---|---|---|---|---|---|---|
| Example | 16 | MMA | 17.0 | 5.5 | | — | EM (23) | 13.0 | Lead methacrylate 35.5 | Lead octanoate 29.0 |
| " | 17 | MMA<br>tert-Butyl methacrylate | 7.0<br>5.0 | 6.5 | HEA | 7.0 | EA(3) | 11.0 | Lead acrylate 14.5 | Lead naphthenate 29.0 |
| " | 18 | MMA | 34.0 | — | | — | EM(23) | 7.5 | Lead methacrylate 18.5 | Lead octanoate 40.0 |
| " | 19 | MMA | 34.0 | 8.0 | | — | PM(9) | 30.0 | Lead methacrylate 12.0 | Lead linolenate 16.0 |
| " | 20 | MMA | 7.5 | — | HEMA | 5.0 | EA(14) | 12.5 | Lead methacrylate 46.5 | Lead octanoate 28.5 |
| " | 21 | MMA | 12.0 | 6.5 | HPA | 7.0 | 1,6-Hexanediol diacrylate | 11.0 | Lead methacrylate 17.5<br>Lead acrylate 17.0 | Lead octanoate 29.0 |
| " | 22 | MMA | 6.0 | 3.5 | HEA | 5.0 | Trimethylolpropane trimethylacrylate | 22.0 | Lead methacrylate 34.5 | Lead octanoate 29.0 |
| Control | 5 | MMA | 30.0 | 5.5 | | — | — | | Lead methacrylate 35.5 | Lead octanoate 29.0 |

Table 3-continued

| Example No. | Substrate Monomer: Alkyl methacrylate (g) | Styrene (g) | Hydroxyalkyl (meth(acrylate (g) | Other substrate monomer ingredient (g) | Lead acrylate or methacrylate (g) | Lead carboxylate (g) |
|---|---|---|---|---|---|---|
| " 6 | MMA 34.0 | 5.5 | — | EM(23) 2.0 | Lead methacrylate 18.5 | Lead octanoate 40.0 |
| " 7 | MMA 3.9 | — | — | EM(23)6 Lead methacrylate 65.5 | Lead octanoate | 23.0 |
| " 8 | MMA 64.0 | 8.0 | — | Lead methacrylate 12.0 | Lead linolenate | 16.0 |
| " 9 | MMA 12.0 | 6.5 | HEA 7.0 | Ethyleneglycol dimethacrylate 11.0 | Lead methacrylate 34.5 | Lead octanoate 29.0 |
| " 10 | MMA 12.0 | 6.5 | HEA 7.0 | Divinylbenzene 11.0 | Lead methacrylate 34.5 | Lead octanoate 29.0 |
| " 11 | MMA 12.0 | 6.5 | HEA 7.0 | EMM (9) 11.0 | Lead methacrylate 34.5 | Lead octanoate 29.0 |

MMA = methyl methacrylate
HEMA = 2-hydroxyethyl methacrylate
EM = polyethyleneglycol dimethacrylate
PM = polypropyleneglycol dimethacrylate
HEA = 2-hydroxyethyl acrylate
HPA = 2-hydroxypropyl acrylate
EA = polyethyleneglycol diacrylate
EMM = methoxy polyethyleneglycol methacrylate
Mumerical figure in the blanks placed after EM, EA, PM or EMM represents the number of ethylene oxide or propylene oxide repeating units.

Table 4

| Example No. | Thickness (mm) | Total light transmittance* (%) | Dynstat impact strength** *kg-cm/cm$^2$) | Lead equivalent*** (mm Pb) |
|---|---|---|---|---|
| Example 16 | 4 | 86 | 20.0 | 0.17 |
| " 17 | 4 | 88 | 10.4 | 0.16 |
| " 18 | 4 | 89 | 16.5 | 0.14 |
| " 19 | 4 | 82 | 18.5 | 0.07 |
| " 20 | 4 | 79 | 9.7 | 0.21 |
| " 21 | 4 | 86 | 9.8 | 0.17 |
| " 22 | 4 | 75 | 8.5 | 0.16 |
| Control | | | | |
| 5 | 4 | 83 | 2.9 | 0.17 |
| " 6 | 4 | 88 | 1.8 | 0.14 |
| " 7 | 4 | 73 | 0.6 | 0.29 |
| " 8 | 4 | 86 | 8.7 | 0.07 |
| " 9 | 4 | 79 | 3.2 | 0.16 |
| " 10 | 4 | 75 | 3.5 | 0.16 |
| " 11 | 4 | 85 | 3.0 | 0.16 |

*Total light transmittance was measured according to ASTM D 1003.
**Dynstat impact strength was measured according to DIN 53453 (without notch).
***Lead equivalent represents the value for X-ray at the energy of 68.8 keV.

What is claimed is:

1. An optically transparent radiation shielding material of a composition containing a polymer comprising (A) at least one essential monomer selected from the group consisting of alkyl methacrylate having 1–4 carbon atoms in an alkyl group, hydroxyalkyl acrylate, hydroxyalkyl methacrylate and styrene and (B) lead acrylate or lead methacrylate, and a lead carboxylate represented by the general formula: $(RCOO)_aPb$, a being an integer equal to the valency of lead and R representing a saturated or unsaturated hydrocarbon residue non-substituted or substituted with a hydroxyl group and having 5–20 carbon atoms, wherein the ratio x (% by weight) of the lead acrylate or the lead methacrylate to the total constituent monomer in the polymer and the compounding ratio y (parts by weight) of the lead carboxylate to 100 parts by weight of said total monomer in said composition satisfy anyone of the following three formulas I, II and III:

$$200 \geqq y \geqq 2, \text{ where } 9 \leqq x \leqq 30 \quad \text{(I)}$$

$$200 \geqq y \geqq 2/5\,(x - 30) + 2, \text{ where } 30 \leqq x \leqq 75 \quad \text{(II) and}$$

$$200 \geqq y \geqq -(9/10)\,(x - 75) + 20, \text{ where } 75 \leqq x \leqq 95 \quad \text{(III).}$$

2. A radiation shielding material as defined in claim 1, wherein a is an integer between 2–4 inclusive and R is a saturated or unsaturated aliphatic hydrocarbon residue non-substituted or substituted with a hydroxyl group and having 5–20 carbon atoms in the general formula: $(RCOO)_aPb$ for representing the lead carboxylate.

3. A radiation shielding material as defined in claim 2, wherein a is an integer between 2–4 inclusive and R is a saturated or unsaturated, non-substituted aliphatic hydrocarbon residue having 5–20 carbon atoms in the general formula: $(RCOO)_aPb$ for representing the lead carboxylate.

4. A radiation shielding material as defined in claim 2, wherein a is an integer between 2–4 inclusive and R is a saturated or unsaturated aliphatic hydrocarbon residue substituted with a hydroxyl group and having 5–20 carbon atoms in the general formula: $(RCOO)_aPb$ for representing the lead carboxylate.

5. A radiation shielding material as defined in claim 3, wherein a is 2 and R is a saturated or unsaturated aliphatic hydrocarbon residue having 5–18 carbon atoms in the general formula: $(RCOO)_aPb$ for representing the lead carboxylate.

6. A radiation shielding material as defined in claim 4, wherein a is 2 and R is a saturated or unsaturated aliphatic hydrocarbon residue having 5–18 carbon atoms in the general formula: $(RCOO)_aPb$ for representing the lead carboxylate.

7. A radiation shielding material as defined in claim 5, wherein the lead carboxylate is selected from the group consisting of lead hexanoate, octanoate, decanoate, laurate, myristate, palmitate, stearate, myristoleate, palmitoleate, oleate, linoleate, linolenate and naphthenate.

8. A radiation shielding material as defined in claim 6, wherein the lead carboxylate is lead ricinoleate.

9. A radiation shielding material as defined in claim 1, wherein the hydroxyalkyl acrylate or hydroxyalkyl methacrylate contains an alkyl group having 2–4 carbon atoms.

10. A radiation shielding material as defined in claim 9, wherein the hydroxyalkyl acrylate or the hydroxyalkyl methacrylate is hydroxyethyl acrylate or hydroxyethyl methacrylate.

11. A radiation shielding material as defined in claim 1, wherein the alkyl methacrylate is methyl methacrylate.

12. A radiation shielding material as defined in claim 1, wherein the ratio x (% by weight) of the lead acrylate or the lead methacrylate to the total constituent monomer in the polymer and the compounding ratio y (parts by weight) of the lead carboxylate to 100 parts by weight of said total monomer contained in said composition can satisfy either of the above formulas I or II.

13. An optically transparent radiation shielding material of a composition containing a polymer comprising (A) a substrate monomer comprising (a) at least one essential monomer selected from the group consisting of alkyl methacrylate having 1–4 carbon atoms in the alkyl group, hydroxyalkyl acrylate, hydroxyalkyl methacrylate and styrene, and (b) 8–75% by weight of the substrate monomer of at least one polyfunctional monomer selected from the group consisting of a monomer represented by the general formula:

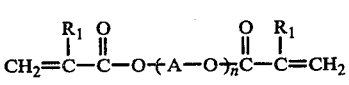

(IV), where $R_1$ is H or $CH_3$, A is an alkylene group having 2–4 carbon atoms and n is an integer between 2–60 inclusive and a monomer represented by the formula:

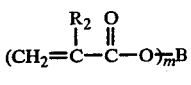

(V)

where $R_2$ is H or $CH_3$, B is a saturated or unsaturated hydrocarbon residue having 4–25 carbon atoms and m is an integer between 2–4 inclusive and (B) lead acrylate or lead methacrylate, and a lead carboxylate represented by the general formula: $(RCOO)_aPb$, a being an integer equal to the valency of lead and R represents a saturated or unsaturated hydrocarbon residue non-substituted or substituted with a hydroxyl group and having 5–20 carbon atoms, wherein the ratio x (% by weight) of the lead acrylate or the lead methacrylate to the total constituent monomer in the polymer and the compounding ratio y (parts by weight) of the lead carboxylate to 100 parts by weight of the total monomer in said composition can satisfy either of the following formula I or II:

$$200 \geqq y \geqq 2 \text{ where } 9 \leqq x \leqq 30 \quad \text{(I) and}$$

$$200 \geqq y \geqq 2/5\,(x - 30) + 2 \text{ where } 30 \leqq x \leqq 75 \quad \text{(II).}$$

14. A radiation shielding material as defined in claim 13, wherein the polyfunctional monomer is contained in an amount of 12–60% by weight to the total substrate monomer composed of said polyfunctional monomer and the essential monomer.

15. A radiation shielding material as defined in claim 13, wherein the repetition number n in the general formula IV for the polyfunctional monomer is an integer between 3–30.

16. A radiation shielding material as defined in claim 13, wherein B in the general formula V for another polyfunctional monomer represents a saturated or unsaturated hydrocarbon residue having 4–15 carbon atoms.

17. A process for producing an optically transparent radiation shielding material which comprises polymerizing a monomer mixture of (A) at least one essential monomer selected from the group consisting of alkyl methacrylate having 1–4 carbon atoms in an alkyl group, hydroxyalkyl acrylate, hydroxyalkyl methacrylate and styrene and (B) lead acrylate or lead methacrylate in the presence of a lead carboxylate represented by the general formula: $(RCOO)_aPb$ a being an integer equal to the valency of lead and R representing a saturated or unsaturated hydrocarbon residue non-substituted or substituted with a hydroxyl group and having 5–20 carbon atoms, wherein the ratio x (% by weight) of the lead acrylate or the lead methacrylate to said monomer mixture and the compounding ratio y (parts by weight) of the lead carboxylate to 100 parts by weight of said monomer mixture satisfy anyone of the following formulas I, II and III:

$$200 \geqq y \geqq 2, \text{ where } 9 \leqq x \leqq 30 \quad \text{(I)}$$

$$200 \geqq y \geqq 2/5\,(x - 30) + 2, \text{ where } 30 \leqq x \leqq 75 \quad \text{(II) and}$$

$$200 \geqq y \geqq -(9/10)\,(x - 75) + 20, \text{ where } 75 \leqq x \leqq 95 \quad \text{(III).}$$

18. A process as defined in claim 17, wherein a is an integer between 2–4 inclusive and R is a saturated or unsaturated aliphatic hydrocarbon residue non-substituted or substituted with a hydroxyl group and having 5–20 carbon atoms in the general formula: $(RCOO)_aPb$ for representing the carboxylate.

19. A process as defined in claim 18, wherein a is an integer between 2–4 inclusive and R is a saturated or unsaturated non-substituted aliphatic hydrocarbon residue having 5–20 carbon atoms in the general formula: $(RCOO)_aPb$ for representing the lead carboxylate.

20. A process as defined in claim 18, wherein a is an integer between 2–4 inclusive and is a saturated or unsaturated aliphatic hydrocarbon residue substituted with a hydroxyl group and having 5–20 carbon atoms in the general formula: $(RCOO)_aPb$ for representing the lead carboxylate.

21. A process as defined in claim 19, wherein a is 2 and R is a saturated or unsaturated aliphatic hydrocarbon residue having 5–18 carbon atoms in the general formula: $(RCOO)_aPb$ for representing the lead carboxylate.

22. A process as defined in claim 20, wherein a is 2 and R is a saturated or unsaturated aliphatic hydrocarbon residue having 5–18 carbon atoms in the general formula: $(RCOO)_aPb$ for representing the lead carboxylate.

23. A process as defined in claim 21, wherein the lead carboxylate is selected from the group consisting of lead hexanoate, octanoate, decanoate, laurate, myristate, palmitate, stearate, myristoleate, palmitoleate, oleate, linoleate, linolenate and naphthenate.

24. A process as defined in claim 22, wherein the lead carboxylate is lead ricinoleate.

25. A process as defined in claim 17, wherein the hydroxyalkyl acrylate or hydroxyalkyl methacrylate contains an alkyl group having 2–4 carbon atoms.

26. A process as defined in claim 25, wherein the hydroxyalkyl acrylate or hydroxyalkyl methacrylate is hydroxyethyl acrylate or hydroxyethyl methacrylate.

27. A process as defined in claim 17, wherein the alkyl methacrylate is methyl methacrylate.

28. A process as defined in claim 17, wherein the polymerization reaction is effected at a temperature between −10° and +150° C. in the presence of an initiator for radical polymerization.

29. A process as defined in claim 28, wherein the polymerization reaction is effected at a temperature between 40° and 130° C. in the presence of an initiator for radical polymerization.

30. A process as defined in claim 17, wherein the ratio x (% by weight) of the lead acrylate or the lead methacrylate to the monomer mixture and the compounding ratio y (parts by weight) of the lead carboxylate to 100 parts by weight of the monomer mixture can satisfy either of the formulas I or II described above.

31. A process for producing an optically transparent radiation shielding material which comprises polymerizing a monomer mixture of (A) a substrate monomer composed of (a) at least one essential monomer selected from the group consisting of alkyl methacrylate having 1–4 carbon atoms in the alkyl group, hydroxyalkyl acrylate, hydroxyalkyl methacrylate and styrene, and (b) 8–75% by weight said substrate monomer of at least one polyfunctional monomer selected from the group consisting of a monomer represented by the formula:

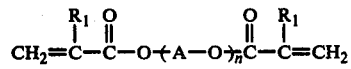

(IV)

where $R_1$ is H or $CH_3$, A is an alkylene group having 2–4 carbon atoms and n is an integer between 2–60 inclusive and a monomer represented by the formula:

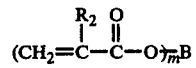

(V)

where $R_2$ is H or $CH_3$, B is a saturated or unsaturated hydrocarbon residue having 4–25 carbon atoms and m is an integer between 2–4 inclusive and (B) lead acrylate or lead methacrylate in the presence of a lead carboxylate represented by the formula: $(RCOO)_aPb$, a being an integer equal to the valency of lead and R representing a saturated or unsaturated hydrocarbon residue nonsubstituted or substituted with a hydroxyl group and having 5–20 carbon atoms, wherein the ratio x (% by weight) of the lead acrylate or the lead methacrylate to said monomer mixture and the compounding ratio y (parts by weight) of the lead carboxylate to 100 parts by weight of said monomer mixture satisfy either of the following formulas I or II:

$$200 \geqq y \geqq 2 \text{ where } 9 \leqq x \leqq 30 \quad \text{(I) and}$$

$$200 \geqq y \geqq 2/5\,(x - 30) + 2 \text{ where } 30 \leqq x \leqq 75 \quad \text{(II).}$$

32. A process as defined in claim 31, wherein the polyfunctional monomer is contained in an amount between 12–60% by weight to the total substrate monomer composed of said polyfunctional monomer and the essential monomer.

33. A process as defined in claim 31, wherein the repetition number n in the general formula IV for the polyfunctional monomer is an integer between 3–30.

34. A process as defined in claim 31, wherein B in the general formula V for another polyfunctional monomer represents a saturated or unsaturated hydrocarbon residue having 4–15 carbon atoms.

* * * * *

UNITED STATES PATENT AND TRADEMARK OFFICE

CERTIFICATE OF CORRECTION

PATENT NO. : 4,129,524

DATED : December 12, 1978

INVENTOR(S) : Nagai et al.

It is certified that error appears in the above-identified patent and that said Letters Patent are hereby corrected as shown below:

Col. 2, line 9; "has been" should read -- has not been --

Col. 3, line 62; "24" should read -- 25 --

Table 1, Ex. No. 9, Second column from right; "20" should read -- 19 --

Table 1, Ex. No. 10, under column heading "Lead carboxylate (g)"; "myriatate" should read -- myristate --

Table 1, Second column from right, Control 1; "L"
and
Control 2; "B" should be placed under column heading "Polymerization initiator"

Table 1, under column heading "Other monomer ingredient (g)", Control 4, last line; "nitrile" AND Table 1-continued, under column heading "Other monomer ingredient (g)", first line; "/35" should have been written together and should read -- nitrile/35 --

Table 2, in the column heading "Total light transmittance(%)" should read -- Total light transmittance*(%) -- Response and Amendment dated 7/18/78, page 2.

The column heading of Table 3 and Table 3-continued; "Hydroxyalkyl (meth(acrylate (g)" should read -- Hydroxyalkyl (meth)acrylate (g) --

UNITED STATES PATENT AND TRADEMARK OFFICE

CERTIFICATE OF CORRECTION

PATENT NO. : 4,129,524

DATED : December 12, 1978

INVENTOR(S) : Nagai et al.

It is certified that error appears in the above-identified patent and that said Letters Patent are hereby corrected as shown below:

Table 3, under column heading "Lead acrylate or methacrylate (g)", Control 5; "29.0" should be placed under the column heading "Lead carboxylate (g)"

Table 3-continued, under column heading "Other substrate monomer ingredient (g)", Control 6; "-EM(23)" the dash should be placed under column heading "Hydroxyalkyl (meth)acrylate (g)" and the EM(23) should be under the column heading "Other substrate monomer ingredient (g)".

Table 3-continued, Control 7, between column heading "Hydroxyalkyl (meth)acrylate (g)" and column heading "Other substrate monomer ingredient (g)" "EM(23)6" should be written as -- EM(23) -- under the column heading "Other substrate monomer ingredient (g)" and -- 7.6 -- under the third column from the right.

Table 3-continued, Control 7, under the third column from the right; "Lead methacrylate 65.5" should be placed under column heading "Lead acrylate or methacrylate (g)" and should read -- Lead methacrylate 65.5 --

Table 3-continued, Control 7, under the column heading "Lead acrylate or methacrylate (g)" "Lead octanoate" should be placed under the column heading "Lead carboxylate (g)" and should then read -- Lead octanoate 23.0--

UNITED STATES PATENT AND TRADEMARK OFFICE

CERTIFICATE OF CORRECTION

PATENT NO. : 4,129,524

DATED : December 12, 1978

INVENTOR(S) : Nagai et al.

It is certified that error appears in the above-identified patent and that said Letters Patent are hereby corrected as shown below:

Table 3-continued, Control 8, under column heading "Other substrate monomer ingredient (g)" it is blank. There should be a dash, -- — --, in the place of the blank.

Table 3-continued, Control 8, under the third column from the right "Lead methacrylate 12.0" should be placed under column heading "Lead acrylate or methacrylate (g)" and should read -- Lead methacrylate 12.0 --

Table 3-continued, Control 8, under the column heading "Lead acrylate or methacrylate (g)" "Lead linolenate" should be placed under the column heading "Lead carboxylate (g)" and should then read -- Lead linolenate 16.0 --

Col. 12, lines 62 & 63 ; "$(RCOO-)_aPb$" should read -- $(RCOO)_aPb$ -- (do not hyphenate)

Signed and Sealed this

*Fifteenth* Day of *May 1979*

[SEAL]

*Attest:*

RUTH C. MASON
*Attesting Officer*

DONALD W. BANNER
*Commissioner of Patents and Trademarks*